United States Patent [19]

Pagliarello

[11] Patent Number: 4,720,946

[45] Date of Patent: Jan. 26, 1988

[54] METHOD AND STRUCTURE FOR INSTALLING DROP CEILING TILES CLOSE TO CEILING

[76] Inventor: Saverio J. Pagliarello, 1577 W. 3rd St., Brooklyn, N.Y. 11204

[21] Appl. No.: 860,908

[22] Filed: May 8, 1986

[51] Int. Cl.[4] ..... E04B 5/52

[52] U.S. Cl. ..... 52/39; 52/127.7; 52/484

[58] Field of Search ..... 52/127.6–127.8, 52/39, 476, 482, 484, 775

[56] References Cited

U.S. PATENT DOCUMENTS 2,059,483 11/1936 Parsons ..... 52/484

2,942,704 6/1960 Stubbs ..... 52/476

3,035,672 5/1962 Tuten ..... 52/484

FOREIGN PATENT DOCUMENTS 517916 5/1921 France ..... 52/39

*Primary Examiner*—Carl D. Friedman

*Attorney, Agent, or Firm*—Richard L. Miller

[57] ABSTRACT

A method for installing drop ceiling tiles close to a ceiling is provided and consists of attaching a plurality of grid clip holders to the ceiling, inserting a plurality of T-clips into the grid clip holders, inserting a plurality of main T-members into the T-clips and placing a plurality of ceiling tiles into the main T-members so that the ceiling tiles are close to the ceiling.

5 Claims, 7 Drawing Figures

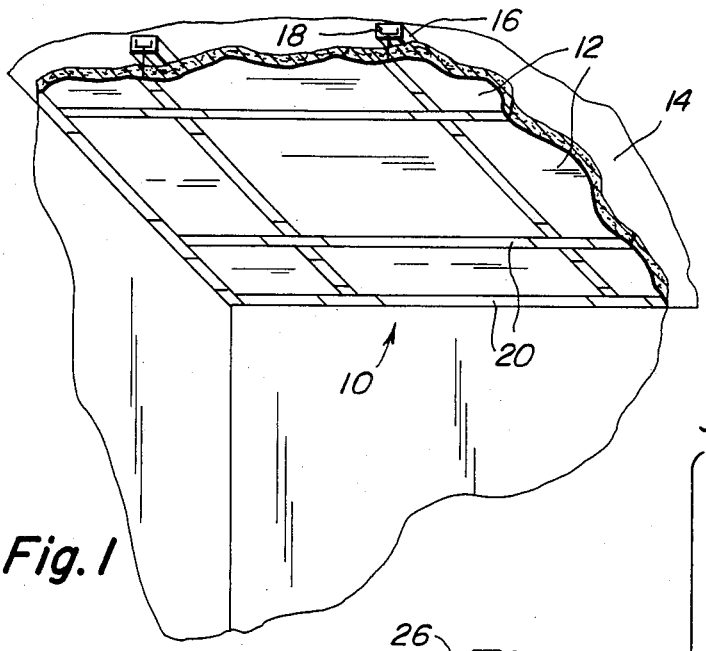
Fig. 1
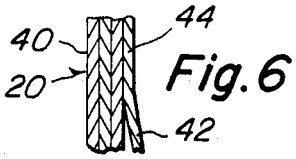
Fig. 6
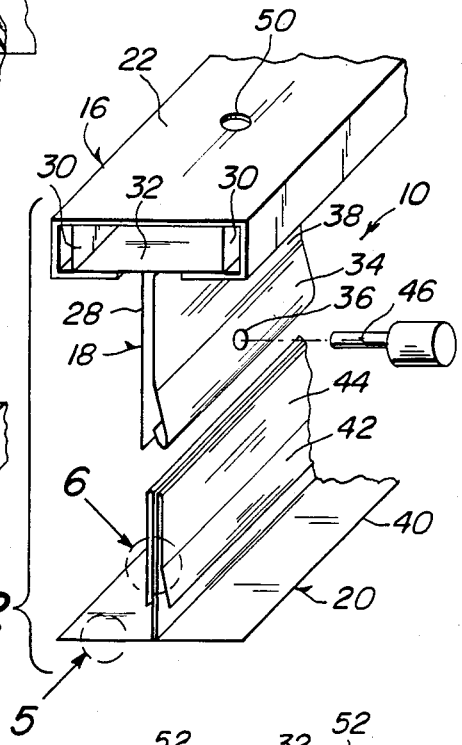
Fig. 2
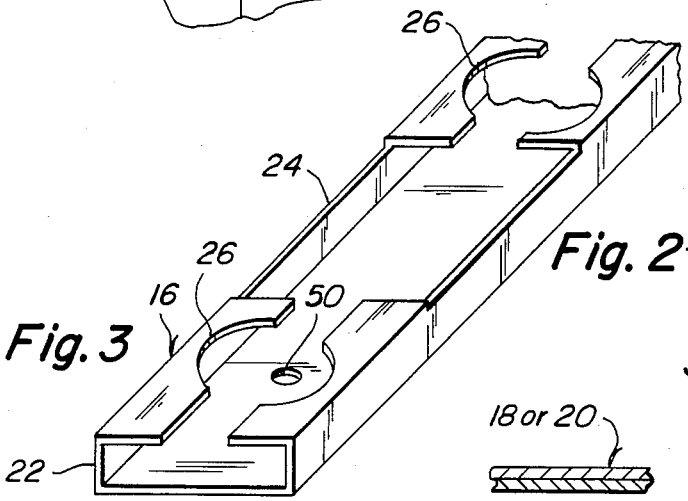
Fig. 3
Fig. 5
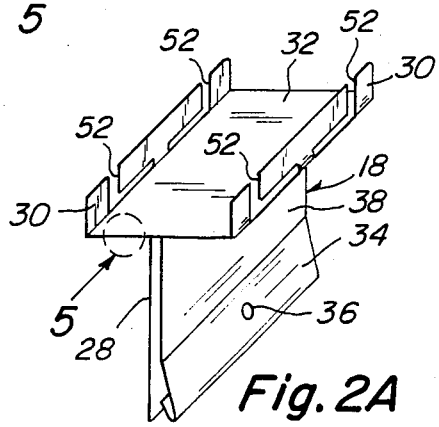
Fig. 2A
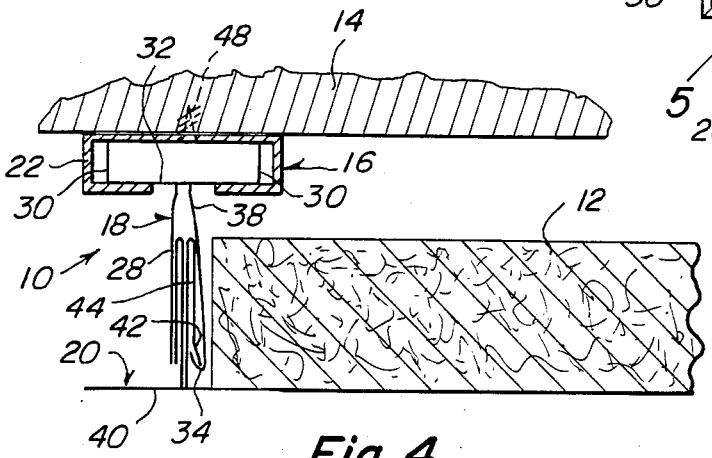
Fig. 4

METHOD AND STRUCTURE FOR INSTALLING DROP CEILING TILES CLOSE TO CEILING

BACKGROUND OF THE INVENTION

The instant invention relates generally to false ceiling assemblies and more specifically it relates to a method for installing drop ceiling tiles close to a ceiling.

Numerous false ceiling assemblies have been provided in prior art that are adapted to suspend supporting grids from existing ceilings so that panels can be hung therefrom. For example, U.S. Pat. Nos. numbered 3,831,328; 3,842,561 and 3,859,770 all are illustrative of such prior art. While these units may be suitable for the particular purpose to which they address, they would not be as suitable for the purposes of the present invention as heretofore described.

SUMMARY OF THE INVENTION

A primary object of the present invention is to provide a method for installing drop ceiling tiles close to a ceiling that will overcome the shortcomings of the prior art devices.

Another object is to provide a method for installing drop ceiling tiles close to a ceiling where the space needed for their installation is either not available or desirable.

An additional object is to provide a method for installing drop ceiling tiles close to a ceiling that offers a quick installation alternative to anyone wishing to use the ceiling tiles for other than a drop ceiling.

A further object is to provide a method for installing drop ceiling tiles close to a ceiling that is simple and easy to use.

A still further object is to provide a method for installing drop ceiling tiles that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of a corner inside a room shown the invention installed therein.

FIG. 2 is an exploded perspective view with parts broken away showing the structure of the invention in greater detail.

FIG. 2A is a perspective view of just the T-clip.

FIG. 3 is a perspective view with the parts broken away of one component of the invention flipped over upside down showing further details thereof.

FIG. 4 is a cross sectional view of the invention being used to secure tiles close to an existing ceiling.

FIG. 5 is a partial enlarged cross sectional view illustrating the detailed construction of the area in the dotted circles of FIG. 2, and 2A.

FIG. 6 is a partial enlarged cross sectional view illustrating the detailed construction of the area in the dotted circle of FIG. 2.

DETAILED DESCRIPTION OF THE PREFERRED EMBODIMENTS

Turning now descriptively to the drawings in which similar reference characters denote similar elements throughout the several views, FIGS. 1, 2 and 4 illustrate a grid clip lock system 10 for installing drop ceiling tiles 12 close to a ceiling 14. The system 10 consists of a plurality of grid clip holders 16 attached to the ceiling 14, a plurality of T-clips 18 inserted into the grid clip holders 16 and a plurality of main T-members 20 inserted into the T-clips 18. The ceiling tiles 12 are placed into the main T-members 20 so that the ceiling tiles are close to the ceiling 14.

As best seen in FIG. 3, each of the grid clip holders 16 is an elongated C-shaped track 22 that has a first set of open gaps 24 to allow for the T-clips 18 to be inserted therein after the grid clip holder 16 is attached to the ceiling 14. A second set of open gaps 26 are provided with side retaining arms to allow for the attachment of the grid clip holder to the ceiling.

As best seen in FIGS. 2, 2A and 5 each of the T-clips 18 is of a limited length and is fabricated out of one continuous piece of thin metal formed in a general T-shaped configuration 28 that has a pair of upstanding spaced apart arms 30 on ends of horizontal portion 32 and a hook 34 and hole 36 on one vertical portion 38. As best seen in FIGS. 2, 4, 5 and 6, each of the main T-members 20 is of an elongated length and fabricated out of one continuous piece of thin metal formed in a general inverted T-shaped configuration 40 that has a bent end 42 on one vertical portion 44 so that the bent end 42 will grip the hook 34 in the T-clip 18 when inserted therein.

FIG. 2 shows how the main T-member 20 may be removed from the T-clip 18. The main T-member 20 is pushed upwardly while a tool 46 is inserted through the hole 36 in the T-clip 18 to disengage the main T-member therefrom. When pulling the main T-member 20 downwardly the main T-member will be removed from the T-clip 18.

A plurality of fasteners 48, such as screws, are provided which are inserted through holes 50 in the grid clip holders 16 at the second set of open gaps 26 for attaching the grip clip holders to the ceiling 14.

As shown in FIG. 2A each of the arms 30 of the T-clip 18 has a pair of L-shaped cut out areas 52, one of which is a mirror image of the other cut out area 52 so that the T-clips 18 can be inserted transversely across the grid clip holders 16 when needed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A grid lock system for installing drop ceiling tiles close to a ceiling comprising:

(a) a plurality of grid clip holders externally attached to a ceiling;

(b) a plurality of T-clips removably inserted into said grid clip holders, wherein each of said grid clip holders includes an elongated C-shaped track having a first set of open gaps to allow for said T-clips to be inserted therein after said grid clip holder is attached to said ceiling and a second set of open gaps including retaining arms to allow for the attachment of said grid clip holder to said ceiling and into which said T-clips are slid and therein retained; and (c) a plurality of main T-members slidably inserted into a said T-clips in which said ceiling tiles are placed into said main T-members so that said ceiling tiles are close to said ceiling.

2. A grid lock system as recited in claim 1 further comprising:

(a) each of said T-clips being of a limited length and fabricated out of one continuous piece of thin metal formed in a general T-shaped configuration having a pair of upstanding spaced apart arms on ends of horizontal portion and a hook and hole on one vertical portion; and (b) each of said main T-members being of an elongated length and fabricated out of one continuous piece of thin metal formed in a general inverted T-shaped configuration having a bent end on one vertical portion so that said bent end will grip said hook in said T-clip when inserted therein.

3. A grid clip lock system as recited in claim 2 further comprising a tool for disengaging each of said main T-members from each of said T-clips whereby after said main T-member is pushed upwardly said tool is pushed into said hole on said one vertical portion of said main T-member thereby allowing said main T-member to be pulled downwardly for removing said main T-member therefrom.

4. A grid lock system as recited in claim 3 further comprising a plurality of fasteners inserted through said grid clip holders at said second set of said open gaps for attaching said grid clip holders to said ceiling.

5. A grid lock system as recited in claim 4 wherein each of said arms of each of said T-clips having a pair of L-shaped cut out areas one of which is a mirror image of said other cut out area and into which said retaining arms slide so that said T-clips can be inserted transversely across said grid clip holders when needed.

* * * * *